US006827418B2

(12) United States Patent
Otokita

(10) Patent No.: US 6,827,418 B2
(45) Date of Patent: Dec. 7, 2004

(54) PRINTING APPARATUS FOR CONTROLLING PRINT ACCORDING TO PRINTING MEDIA

(75) Inventor: Kenji Otokita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/180,066

(22) Filed: Jun. 27, 2002

(65) Prior Publication Data

US 2003/0016259 A1 Jan. 23, 2003

(30) Foreign Application Priority Data

Jun. 28, 2001 (JP) ..... 2001-197026
Aug. 13, 2001 (JP) ..... 2001-245432

(51) Int. Cl.[7] ..... B41J 29/393; B41J 29/38

(52) U.S. Cl. ..... 347/19; 347/10; 347/11; 347/12

(58) Field of Search ..... 347/19, 10, 12, 347/11, 23, 14, 37, 7, 15, 43, 40, 41; 358/298; 400/279

(56) References Cited

U.S. PATENT DOCUMENTS 5,617,122 A * 4/1997 Numata et al. ..... 347/14
6,260,938 B1 * 7/2001 Ohtsuka et al. ..... 347/15

FOREIGN PATENT DOCUMENTS

JP 2000-355146 12/2000
WO WO 98/52762 11/1998

* cited by examiner

*Primary Examiner*—Stephen D. Meier
*Assistant Examiner*—Charles Stewart
(74) *Attorney, Agent, or Firm*—Sughrue Mion, PLLC

(57) ABSTRACT

A printing apparatus according to the present invention comprises a printing medium, print-control information, identifying means, determining means, and controlling means. Here, a printing medium has a storage element storing print-control information adapted to the type of the printing medium. The print-control information is provided in advance in the printing apparatus. The identifying means identifies the type of the printing medium being set. The determining means determines whether or not print-control information adapted to the type of the printing medium identified by the identifying means is included in the print-control information provided in advance. The controlling means controls printing using either the print-control information provided in advance or the print-control information stored in the storage element according to the result of determination by the determining means. The printing apparatus can carry out appropriate printing according to the printing medium.

33 Claims, 9 Drawing Sheets

| | PAPER TYPE A | PAPER TYPE B | PAPER TYPE C | .... |
|---|---|---|---|---|
| LUT | ○ | ○ | ○ | .... |
| DRIVING WAVEFORM | ○ | × | ○ | .... |
| PAPER-FEED CORRECTION | × | ○ | ○ | .... |
| PASS-REST TIME-LENGTH | × | ○ | ○ | .... |

○: INFORMATION IN ROLL-PAPER MEMORY

×: NO INFORMATION IN ROLL-PAPER MEMORY (SELECTED FROM EXISTING INFORMATION)

FIG. 2

| PAPER TYPE | PAPER THICKNESS | PAPER WIDTH |
|---|---|---|
| PREMIUM | 0.8mm | 4inch |

| PAPER THICKNESS (mm) | P G (mm) | SET VALUE |
|---|---|---|
| 0. 4 | 1. 54 | 1 |
| 0. 6 | 1. 34 | 2 |
| 0. 8 | 1. 14 | 3 |
| 1. 0 | 0. 94 | 4 |

FIG. 9

| PAPER THICK-NESS | PG BEFORE CORREC-TION | CORREC-TING VALUE | PG AFTER CORREC-TION |
|---|---|---|---|
| 0. 4 | 1. 54 | − 0. 4 → | 1. 14 |
| 0. 6 | 1. 34 | − 0. 2 → | 1. 14 |
| 0. 8 | 1. 14 | ±0 → | 1. 14 |
| 1. 0 | 0. 94 | + 0. 2 → | 1. 14 |

FIG. 10

PRINTING APPARATUS FOR CONTROLLING PRINT ACCORDING TO PRINTING MEDIA

BACKGROUND OF THE INVENTION

The present application claims priority upon Japanese Patent Application No. 2001-197026 filed on Jun. 28, 2001 and Japanese Patent Application No. 2001-245432 filed on Aug. 13, 2001, which are herein incorporated by reference.

FIELD OF THE INVENTION

The present invention relates to an improvement of a technique for controlling printing according to a printing medium (throughout the present specification and claims, also referred to as a "recording medium"). For example, the invention relates to control of printing using a long, rolled-up printing medium (referred to as "rolled printing medium" in the present specification and claims).

DESCRIPTION OF THE RELATED ART

While the present invention is applicable to various printing media, such as paper and CDs (Compact Disks), the following explanation will be exemplarily given in terms of paper.

(1) In general, a printer driver contains print-control information respectively according to a plurality of types of paper. Upon printing, the type of the printing paper to be used is designated by a user, and printing is controlled based on the print-control information according to the type of the designated paper.

Now, for example, when a new type of paper not contained in the plurality of types of paper set forth above is added, the printer driver containing and capable of using the print-control information adapted to the new type of paper, i.e., an upgraded printer driver is provided in a predetermined server. When a printing result adapted to the new type of paper is desired, the user operates a printing apparatus loaded with the printer driver so that the printing apparatus accesses the above-mentioned predetermined server and downloads the upgraded printer driver from the server, in order to upgrade the current printer driver.

However, it is troublesome to download the upgraded printer driver by taking the trouble to operate the printing apparatus every time the new type of paper is added.

(2) Conventionally, there is known a printing system carrying out a printing process for a roll paper formed by winding a long, strip-form printing paper on a surface of a core many times. In such a printing system, there has been proposed a system in which, by mounting a semiconductor memory element storing a paper-thickness information of the roll paper on the core, a gap (platen gap) between a printing surface of a print head and a surface of the roll paper on the platen is controlled based on the paper-thickness information read out from the memory element.

Meanwhile, in the printing system relating to the foregoing proposal, while the platen gap is automatically controlled according to paper thickness of the roll paper to be used, it does not have a construction for automatically adjusting a driving range of the print head in the main-scanning direction according to a width of the roll paper and for freely varying the platen gap according to the type of the roll paper. A major reason is that the semiconductor memory element does not store information relating to the width of the roll paper or information relating to the type of the roll paper, other than the paper-thickness information. Therefore, adjustment of the above-described driving range of the print head, adjustment of the platen gap so as not cause grazing of paper when the roll paper to be used is of a material (type) which easily forms creases due to the ink dots ejected from nozzles, and other such adjustments are left for manual setting by the user through the printer driver in a host device.

Therefore, for example, when the user erroneously sets the width of the to-be-used roll paper to be B4 size while the actually-used roll paper has the width corresponding to A4 size, a problem arises in that a printing range exceeds the width of the roll paper. On the other hand, when the platen gap adjusted by the user is inappropriate, a problem may occur in that paper will graze the print head due to creases formed in the roll paper by the ejected ink dots. Furthermore, in the foregoing printing system, since the system is not constructed to automatically correct an actuating timing of the print head (a timing for ejecting ink from the nozzles) upon bidirectional printing according to the paper thickness of the roll paper to be used, difficulty is encountered in implementing a high-quality, bidirectional printing with the printing system set forth above.

SUMMARY OF THE INVENTION

A first object of the present invention is to enable appropriate printing according to a printing medium. Further, another object of the present invention is to enable printing according to a new printing medium when the new printing medium is added, without the user taking the trouble to carry out an operation to enable printing according to the new printing medium.

A printing apparatus according to a main, first invention has a printing medium, print-control information, identifying means, determining means, and controlling means. Here, a printing medium has a storage element storing print-control information adapted to the type of the printing medium. The print-control information is provided in advance in the printing apparatus. The identifying means identifies the type of the printing medium being set. The determining means determines whether or not print-control information adapted to the type of the printing medium identified by the identifying means is included in the print-control information provided in advance. The controlling means controls printing using either the print-control information provided in advance or the print-control information stored in the storage element according to the result of determination by the determining means.

A second object of the present invention is to enable high-quality printing for the recording medium. Another object of the present invention is to avoid occurrence of grazing in view of the print head due to creases formed on the recording medium used in the printing system. Furthermore, another object of the present invention is to avoid discrepancy between a width of the recording medium to be used in the printing system and a set driving range of the print head in a main-scanning direction.

Therefore, a printing system for printing on a recording medium according to a main, second invention includes the recording medium, reading-out means, and adjusting means. Here, the recording medium has a medium-information storing means storing information relating to the medium. Further, the reading-out means reads out information relating to a thickness of the medium from the medium-information storing means. Further, the adjusting means adjusts the actuating timing of the print head upon bidirectional printing based on the read-out information relating to the thickness.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein:

FIG. 2 is a diagram showing a relationship between the type of paper of a roll paper 15 and certain four kinds of data stored in a roll-paper memory 13;

FIG. 9 is an explanatory diagram relating to a timing setting upon bidirectional printing;

FIG. 10 is an explanatory diagram relating to an adjustment of the platen gap.

DESCRIPTION OF THE PREFERRED EMBODIMENTS

Figure 1:
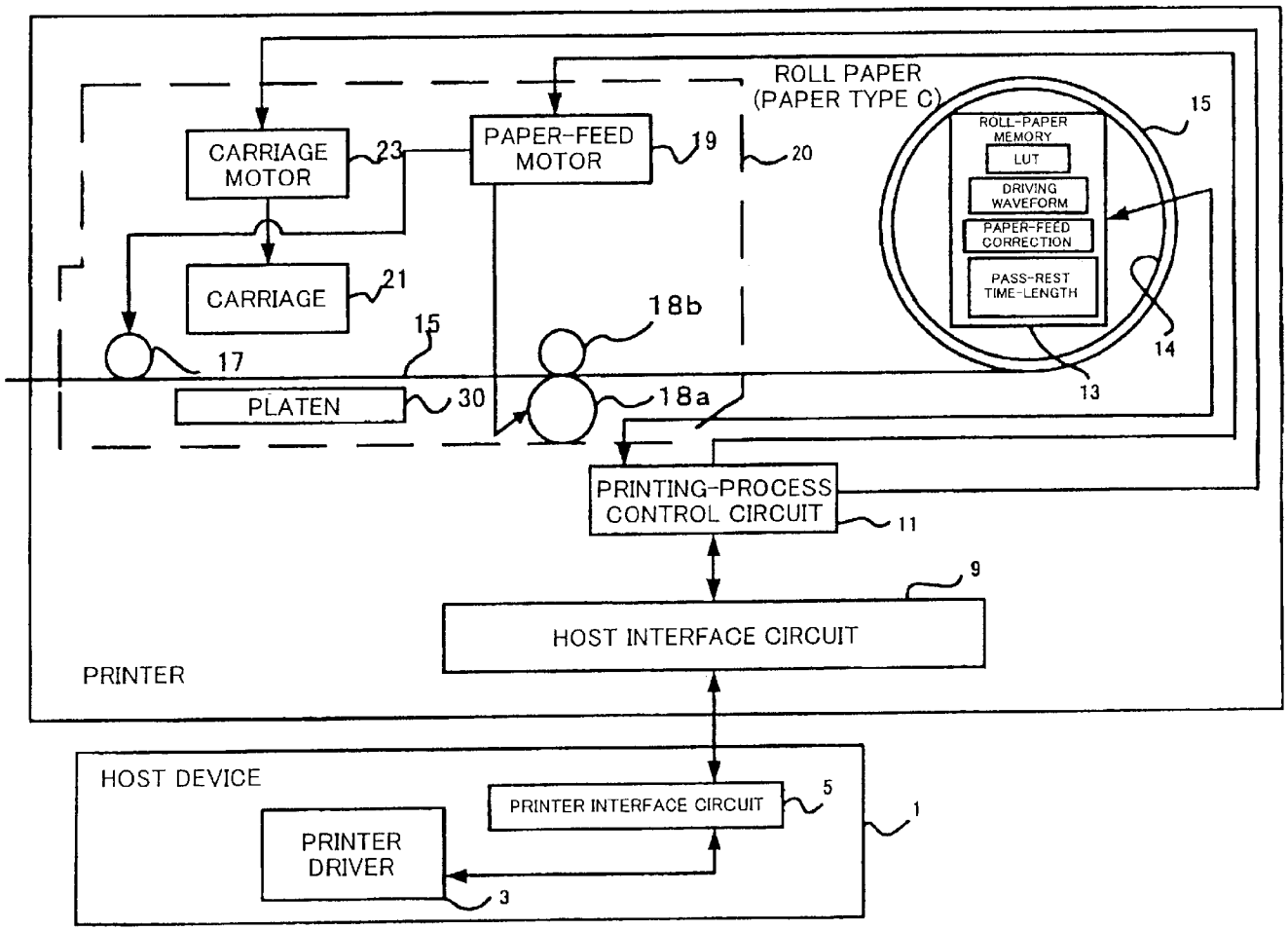
FIG. 1 is a diagram showing a first embodiment of a printing apparatus according to the present invention.

At least the following matters will be made clear by the explanation in the present specification and the description of the accompanying drawings.

A printing apparatus comprises a printing medium, print-control information, identifying means, determining means and controlling means. Here, a printing medium has a storage element storing print-control information adapted to the type of the printing medium. Print-control information is provided in advance in the printing apparatus. The identifying means identifies the type of the printing medium being set. The determining means determines whether or not print-control information adapted to the type of the printing medium identified by the identifying means is included in the print-control information provided in advance. The controlling means controls printing according to the result of determination by the determining means using either the print-control information provided in advance, or the print-control information stored in the storage element.

Further the printing apparatus may further comprise holding means for reading in and holding the print-control information stored in the storage element provided on the printing medium being set. Further, the determining means may also determine whether or not print-control information adapted to the type of the printing medium having been identified is already included in the print-control information held in the holding means; and according to the result of determination by the determining means, the controlling means may control printing using any one of: the print-control information provided in advance; the print-control information held in the holding means; or the print-control information stored in the storage element provided on the printing medium being currently set. Further, when printing is controlled using a plurality of kinds of print-control information respectively used at different stages of printing control, and if some kinds among the plurality of kinds of the print-control information are stored in the storage element and other kinds of the print-control information are not stored, when the controlling means uses the print-control information stored in the storage element according to the result of determination by the determining means, the controlling means may use either: the print-control information stored in the storage element is used for the some kinds; or the print-control information provided in advance, or the print-control information held in the holding means for the other kinds.

Further, the print-control information stored in the storage element may include at least one kind of information among: (1) image-conversion information for converting image data; (2) ink-adhesion-controlling information for controlling an amount of ink adhering to the printing medium; (3) medium-feed-controlling information for controlling an amount of the printing medium to be fed; and (4) ink-drying-period information for controlling a period of time for drying the ink adhering to the printing medium, or, may include information necessary for obtaining at least one kind of the information of (1) to (4).

Further, according to another viewpoint, a printing apparatus for printing on a printing medium comprises identifying means, read-in means, and controlling means. Here, the identifying means identifies a type of the printing medium being used. The read-in means reads in medium-feed-controlling information adapted to the type of the printing medium identified by the identifying means from a location to which the medium-feed-controlling information is stored, the medium-feed-controlling information being information adapted to the type of the printing medium and for controlling an amount of the printing medium to be fed. The controlling means for controlling the amount of the printing medium to be fed based on the medium-feed-controlling information read in by the read-in means.

Further, the printing apparatus can exchangeably be set with a rolled printing medium which is a continuous printing medium being rolled up. The rolled printing medium may include a storage element, the medium-feed-controlling information adapted to a type of the rolled printing medium may be stored in the storage element; and the read-in means may read in the medium-feed-controlling information from the storage element of the rolled printing medium being set to the printing apparatus.

Further, according to another viewpoint, the present invention can be grasped as storage element. That is, the storage element which can be provided on a printing medium stores information. The information is print-control information adapted to a type of the printing medium, and includes at least one kind of information among: (1) image-conversion information for converting image data; (2) ink-adhesion-controlling information for controlling an amount of ink adhering to the printing medium; (3) medium-feed-controlling information for controlling an amount of the printing medium to be fed; and (4) ink-drying-period information for controlling a period of time for drying the ink adhering to the printing medium, or, includes information necessary for obtaining at least one kind of the information of (1) to (4).

Further, according to another viewpoint, the present invention can be grasped as a printing method. That is, the printing method which prints to a printing medium comprising a storage element comprises an identifying step, a determining step, and a controlling step. The identifying step is a step for identifying a type of the printing medium being set to a printing apparatus. The determining step is a step for determining whether or not print-control information adapted to the type of the printing medium having been identified is included in print-control information provided in advance in the printing apparatus. The controlling step is a step for controlling printing according to a result of the determination using either: the print-control information provided in advance, or print-control information stored in the storage element and adapted to the type of the printing medium having been identified.

Further, the present invention can be grasped as another printing method. That is, the printing method performs printing to a printing medium, and comprises an identifying step, a read-in step, and a controlling step. Here, the identifying step is a step for identifying a type of the printing medium being used in a printing apparatus. The read-in step is a step for reading in medium-feed-controlling information adapted to the type of the printing medium having been identified from a location to which the medium-feed-controlling information is stored, the medium-feed-controlling information being information adapted to the type of the printing medium and for controlling an amount of the printing medium to be fed. The controlling step is a step for controlling the amount of the printing medium to be fed based on the medium-feed-controlling information having been read in.

Further, according to another viewpoint, the present invention can be grasped as a storing medium. That is, the storing medium comprises a computer program being recorded readable to a computer, and the computer program makes the computer execute an identifying step, a determining step, and a controlling step. The identifying step is a step for identifying a type of the printing medium being set to a printing apparatus. The determining step is a step for determining whether or not print-control information adapted to the type of the printing medium having been identified is included in print-control information provided in advance in the printing apparatus. The controlling step is a step for controlling printing according to a result of the determination using either: the print-control information provided in advance, or print-control information in the storage element.

Further, according to another viewpoint, the present invention can be grasped as a memory. That is, the memory is provided on a recording medium, and comprises: information relating to a thickness of the recording medium; and information relating to a type of the recording medium. The memory may further comprise information relating to a width of the recording medium. Further, the information relating to the thickness may be read out for adjusting an actuating timing of a print head so as to adapt to the thickness upon bidirectional printing. Further, the information relating to the width may be read out for adjusting a driving range of the print head in a main-scanning direction. Furthermore, the information relating to the type may be read out for deciding whether or not an adjustment of a gap between a print head and the recording medium is necessary; and if it is decided that the adjustment is necessary based on the type, the information relating to the thickness may be read out for adjusting the gap or for adjusting the timing so as to adapt to the thickness.

Further, according to another viewpoint, the present invention can be grasped as a recording medium. That is, the recording medium comprises: a rolled medium; and a memory storing information relating to a thickness of the medium and information relating to a type of the medium.

Further, according to another viewpoint, the present invention can be grasped as a printing system. That is, the printing system for performing printing on a recording medium comprises a recording medium, reading-out means, and adjusting means. Here, the recording medium has medium-information storing means for storing information relating to the medium. The reading-out means reads out information relating to a thickness of the medium from the medium-information storing means. The adjusting means adjusts an actuating timing of a print head upon bidirectional printing based on the information relating to the thickness having been read out.

Further, according to another viewpoint, the present invention can be grasped as another printing system. That is, the printing system for performing printing on a recording medium comprises a recording medium, reading-out means, and adjusting means. Here, the recording medium has medium-information storing means for storing information relating to the recording medium. The reading-out means reads out information relating to a width of the medium from the medium-information storing means. The adjusting means adjusts a driving range of a print head in a main-scanning direction based on the information relating to the width having been read out.

The reading-out means and the adjusting means may be a program set in a host device, and the program may be appropriately downloaded from a server to the host device via a communication network.

Further, according to another viewpoint, the present invention can be grasped as another printing system. That is, the printing system comprises a recording medium, medium-type-information reading-out means, medium-thickness-information reading-out means, deciding means, and adjusting means. Here, the recording medium has medium-information storing means for storing information relating to the recording medium. The medium-type-information reading-out means reads out information relating to a type of the recording medium from the medium-information storing means. The medium-thickness-information reading-out means reads out information relating to a thickness of the recording medium from the medium-information storing means. The deciding means decides whether or not adjustment of an actuating timing of a print head upon bidirectional printing is necessary based on the information relating to the type having been read out. The adjusting means adjusts the actuating timing of the print head upon the bidirectional printing based on the information relating to the thickness having been read out, if it is decided that the adjustment is necessary.

Further, according to another viewpoint, the present invention can be grasped as another printing system. That is, the printing system for performing printing on a recording medium comprises a recording medium, medium-type-information reading-out means, deciding means, and adjusting means. Here, the recording medium has medium-information storing means for storing information relating to the recording medium. The medium-type-information reading-out means reads out information relating to a type of the recording medium from the medium-information storing means. The deciding means decides whether or not adjustment of a gap between a print head and the medium is necessary based on the information relating to the type having been read out. The adjusting means adjusts the gap based on the information relating to the type having been read out, if it is decided that the adjustment is necessary.

The adjusting means may adjust the gap according to a plurality of stages including: a stage performing adjustment with relatively low precision; and a stage performing adjustment with relatively high precision.

Further, according to another viewpoint, the present invention may be grasped as a printing method. That is, a printing method for performing printing on a recording medium comprises a read-out step, and an adjusting step. Here, the read-out step is a step for reading out information relating to a thickness of the recording medium from storage means provided on the recording medium. The adjusting step is a step for adjusting an actuating timing of a print head upon bidirectional printing based on the information relating to the thickness having been read out.

Further, according to another viewpoint, the present invention may be grasped as another printing method. That is, a printing method for performing printing on a recording medium comprises a type read-out step, a thickness read-out step, a deciding step, and an adjusting step. Here, the type read-out step is a step for reading out information relating to a type of the recording medium from storage means provided on the recording medium. The thickness read-out step is a step for reading out information relating to a thickness of the medium from the storage means. The deciding step is a step for deciding whether or not an adjustment of a gap between a print head and the medium is necessary based on the information relating to the type having been read out. The adjusting step is a step for adjusting an actuating timing of the print head upon bidirectional printing based on the information relating to the thickness having been read out, if it is decided that the adjustment is necessary.

Further, according to another viewpoint, the present invention may be grasped as another printing method. That is, a printing method for performing printing on a recording medium comprises a read-out step, a deciding step, and a notifying step. Here, the read-out step is a step for reading out information relating to a type of the recording medium from storage means provided on the recording medium. The deciding step is a step for deciding whether or not an adjustment of a gap between a print head and the medium, or an adjustment of an actuating timing of the print head upon bidirectional printing is necessary, based on the information relating to the type having been read out. The notifying step is a step for notifying a message indicative of a result of the decision to a user, if it is decided that the adjustment is necessary.

This printing method may further comprise a step for, if it is decided that the adjustment is necessary, adjusting the actuating timing of the print head upon bidirectional printing, or adjusting the gap between the print head and the medium, based on the information relating to the thickness having been read out. Further, in this printing method, the step of notifying the user of the message indicative of the result of decision may be a step of making a window including the message indicative of the result of decision pop-up on a display portion of a host device.

Further, according to another viewpoint, the present invention may be grasped as a storing medium storing a program. That is, a storing medium stores a program for performing printing on a recording medium, and the program makes a computer execute a read-out step and an adjusting step. Here, the read-out step is a step for reading out information relating to a thickness of the recording medium from storage means provided on the recording medium. The adjusting step is a step for adjusting an actuating timing of a print head upon bidirectional printing based on the information relating to the thickness having been read out.

Further, according to another viewpoint, the present invention may be grasped as another storing medium. That is, a storing medium stores a program for performing printing on a recording medium, and the program making a computer execute a read-out step, a deciding step, and a notifying step. Here, the read-out step is a step for reading out information relating to a type of the recording medium from storage means provided on the recording medium. The deciding step is a step for deciding whether or not an adjustment of a gap between a print head and the recording medium, or an adjustment of an actuating timing of the print head upon bidirectional printing is necessary, based on the information relating to the type having been read out. The notifying step is a step for, if it is decided that the adjustment is necessary, notifying a message indicative of a result of the decision to a user.

It should be noted that, in the "printing apparatus" according to the present invention, not only a printer per se but also a printing system constructed with a plurality of apparatuses (for example, a printing system employing the printer and a host device) is included. Further, a computer program of the present invention can be installed or loaded in a computer through a disk type storage, a semiconductor memory, a communication network and the like.

A first embodiment of the present invention will be discussed hereinafter in detail with reference to FIG. 1 through FIG. 4.

FIG. 1 shows the overall structure of a printing apparatus according to the first embodiment of the present invention.

In the same figure, a host device 1 is connected to an ink-jet printer (hereinafter referred to as printer) 7 via a printer interface circuit 5. This host device 1 is typically a general-purpose-type computer such as a personal computer, and has a printer driver 3 which is software for performing generation process of print data to be sent to the printer 7.

The printer 7 is connected to the host device 1 via a host interface circuit 9. The printer 7 has a printing-process control circuit 11 performing such as generation of a print image and paper-feed controlling, and a printing mechanism 20 for printing the print image generated by the printing-process control circuit 11 under control of the printing-process control circuit 11.

Although not illustrated, the printing-process control circuit 11 includes such as: a print-head drive circuit; a motor driver circuit; a data-writing circuit for reading/writing data from/to a roll-paper memory 13 which will be discussed later; an input/output circuit of external data; a CPU controlling the entire printing-process control circuit 11; a ROM storing such as a program for the CPU and/or fixed data; and a RAM to be used as such as a reception buffer for temporarily storing data from the host device 1. The printing-process control circuit 11 responds to an instruction from the printer driver 3 (or works independently) and reads out, from the roll-paper memory 13, paper-type data, color-conversion data (hereinafter, LUT), driving-waveform data, paper-feed correcting data and/or pass-rest time-length data, all explained later on, and transfers these data to the printer driver 3 via the host interface circuit 9.

The printing mechanism 20 is structured from, for example: a carriage 21 comprising a not-shown print head; a carriage motor 23 for making the carriage 21 reciprocate in a direction perpendicular to the paper-feed direction; a paper-feed roller 18*a* which feeds a roll paper 15; a driven roller 18*b* which feeds the roll paper 15 with the paper-feed roller 18*a*; a platen 30; a paper-discharge roller 17 for assisting paper feed; a paper-feed motor 19 which makes the paper-feed roller 18*a* roll; not-shown gear mechanisms which transmit the rotation of the paper-feed motor 19 to the paper-feed roller 18*a*, the driven roller 18*b*, and the paper-discharge roller 17; and/or, a not-shown cutter for cutting the roll paper 15 at a predetermined position.

The carriage 21 is structured to be able to detachably mount not-shown ink cartridges for supplying ink to the print head. Note that the ink cartridges that can be mounted to the carriage 21 are, for example, the two types: a black-ink cartridge containing black (K) ink; and a color-ink cartridge containing ink of cyan (C), magenta (M), and yellow (Y). (Not to mention, the color-ink cartridge may be such in which ink of light cyan (LC) and light magenta (LM) is also stored other than the above-mentioned inks.) Further, as for the types of the ink cartridges, there exist an on-carriage type which is installed onto the carriage with the print head; and an off-carriage type which is set to an unmovable location apart from the carriage. The ink cartridges of the present embodiment may be either type. Further, the ink cartridge can be shared among a plurality of printers; for example, after mounting the cartridge to a certain printer and using it for a while, the cartridge may be removed and be remounted to another printer.

The printer 7 is structured to use continuous printing paper having been wound to the outer periphery of a cylindrical core 14. (Hereinafter, this is referred to as a "roll paper".) As for the types of roll papers 15, there are, for example: "plain paper" which has substantially the same quality as a general copy paper; "paper for exclusive use" which is paper corresponding to a predetermined printing mode, and in which a best printing result may be obtained when printing with the above-mentioned printing mode; and "special-purpose sheets" which are, for example, for obtaining a glossy image like a photograph, or for use in special purposes such as for stickers and/or OHPs, and wherein some sheets are made not only of paper but of material other than paper. The roll paper 15 can be shared among a plurality of printers; for example, after mounting the roll paper to a certain printer and using it for a while, the paper may be removed and be remounted to another printer.

On the inner-peripheral surface of the core 14 of the roll paper 15, there is provided a memory (for example, an EEPROM, which is hereinafter referred to as "roll-paper memory") 13 on which predetermined information described later is recorded. The roll-paper memory 13 is, for example, a noncontact-type memory having a region in which data is arbitrarily erasable and a region in which data cannot be arbitrarily erased. For example, although not illustrated, data indicative of a remaining amount of roll paper 15, data regarding production date, and paper-type data indicative of the type of paper of the roll paper 15 are recorded on the roll-paper memory 13. Further, as shown in the drawings, on the roll-paper memory 13 there are recorded four kinds of print-control data: the LUT, the driving-waveform data, the paper-feed correcting data, and the pass-rest time-length data adapted to the type of paper of the roll paper 15. Note that access (data read/write) to the roll-paper memory 13 is carried out by the printing-process control circuit 11; and as an access mode therefor, in the present embodiment, for example, a mode described in paragraphs "0030" through "0032" of the specification and FIG. 1 through FIG. 3 of Japanese Patent Application No. 2000-397634 which is a former application by the present applicant (and which has not been published on Jun. 28, 2001) may be adopted.

In this embodiment, as will be discussed in detail later on, the printing result suitable for the type of paper of the roll paper 15 can be obtained by the printer driver 3 generating the print data based on the four kinds of print-control data transferred from the printer 7 and transferring the print data to the printer 7, and the printer 7 controlling printing based on the print data from the printer driver 3. In this way, if the kinds of the print-control data transferred from the printer 7 is less than the four kinds, regarding the print-control data of the kinds which are missing, the printer driver 3 selects a certain print-control data from the print-control data already held in order to generate the print data using the selected print-control data (the method for performing this process will be discussed later).

That is, in this embodiment, as shown in FIG. 2, the kind of print-control data among the four kinds of print-control data, which are the LUT, the driving-waveform data, the paper-feed correcting data, and the pass-rest time-length data, to be stored in the roll-paper memory 13 is determined according to the paper type (or characteristics) of the roll paper 15. Accordingly, not always are the four kinds of print-control data transferred from the printer 7 to the printer driver 3.

For example, as shown in FIG. 2, when the type of paper of the roll paper 15 is "paper type A", only the LUT and the driving-waveform data among the four kinds of print-control data are stored in the roll-paper memory 13. Further, when the type of paper of the roll paper 15 is "paper type B", the print-control data other than the driving-waveform data are stored in the roll-paper memory 13. When the type of paper of the roll paper 15 is "paper type C", the print-control data of all four kinds are stored in the roll-paper memory 13. (It should be noted that in this embodiment, the type of paper of the roll paper 15 is to be "paper type C", and all four kinds of print-control data, namely, the LUT, the driving-waveform data, the paper-feed correcting data, and the pass-rest time-length data are stored in the roll-paper memory 13.)

Here, the LUT is a color-conversion table (a look-up table) to be referenced for a color-conversion process for converting an original image data of a particular color system (e.g., the original image data of RGB) into an image data of a CMYK color system. Each of the values in the LUT are values adjusted based on, for example, ink duty adapted to the type of paper of the roll paper (or characteristics, for example, tendency of blurring of the ink). (Note that, "ink duty" is a total value of recorded-area rates for each of the colored inks upon reproduction of a predetermined color using a plurality of colors of ink. (A "recorded-area rate" is a rate of occupancy of the ink drops, having penetrated into the roll paper 15 and dried, per unit area of roll paper.) From another viewpoint, it is possible to state that this is a total value of ink amount for each of the colored inks necessary to form one dot having a predetermined color.)

The driving-waveform data is data indicative of the driving waveform (signal waveform) for controlling driving of a driving element of the print head (for example, a piezoelectric element if the printing system is a piezo-type system, and a heating element in case of a thermal ink-jet system). The driving waveform is adjusted for appropriately ejecting (e.g., an appropriate amount of) ink droplets according to the type of paper of the roll paper or, for example, the ink duty which is taken as the basis of the LUT provided according to the type of paper.

The paper-feed correcting data is data on which there is recorded a parameter (hereinafter referred to as paper-feed correcting parameter) for correcting certain paper-feed controlling data stored in advance in the printer driver 3 (or the printer 7). (The control data is, for example, data on which there is recorded a paper-feeding amount (for example, a rotation amount of the paper-feed motor 19) for feeding the paper one dot line. The paper-feeding amount is, for example, an amount that is moderately applicable to a large number of types of paper.) The paper-feed correcting parameter is set based on the type of paper (or characteristics) of the roll paper, for example, the slipperiness of the surface of the roll paper (as a particular example, a friction coefficient of the roll paper surface when the roll paper contacts the platen 30). More particularly, for example, the paper-feed correcting parameter is set so as to realize a correction to make the paper-feeding amount relatively large if the surface of the roll paper is relatively slippery; and on the contrary, the paper-feed correcting parameter is set so as to realize a correction to make the paper-feeding amount relatively small if the surface of the roll paper has a relatively low slipperiness.

The pass-rest time length data is data on which there is recorded how long the carriage 21 is to be rested, without being passed, from when a certain pass of the carriage 21 is started until when a next pass is to be started (hereinafter, this is referred to as "pass-rest time length"). The pass-rest time length is set from a viewpoint of, for example, prevention of ink cohesion (in which the molecules of a plurality of wet ink drops are attracted and the ink drops adhere to each other) and/or contamination of a paper-feed assisting roller 17*b* (in which the wet ink drops adhere to the paper-feed assisting roller 17*b*). Namely, the pass-rest time length is adjusted according to the time length in which the ink adhering on the roll paper 15 completely dries, which time length differs according to, for example, the type of paper of the roll paper and/or the ink duty which has been taken as a basis of the LUTs provided according to the paper type. For example, if the value of the ink duty, which has been taken as a basis of the LUT provided according to the type of paper, is relatively high (or, if the type of paper is such in which the ink is relatively difficult to dry), the pass-rest time length is set to be relatively long.

Incidentally, as shown in the drawings, in certain types of paper, some kinds of the print-control data are not stored. This signifies that, for such a paper type, the data can be replaced by other particular print-control data instead of the adapted print control data. (In other words, no significant difference will appear in the quality of the printing result even when other particular print-control data are used.) As will be discussed later, at the time of a printing process, the printer driver 3 selects a replaceable print-control data among the existing print-control data regarding the kind of print-control data which is not stored in the roll-paper memory 13 (namely, the kind of print-control data missing), and uses the selected print-control data as a substitute. ("Replaceable" means that data can be used as a substantially-same print-control data as the print-control data adapted to the certain type of paper). It should be noted that several methods can be considered to perform this process. As one of those methods, for example, the following method can be considered. That is, as for the replaceable kind of the print-control data, the roll-paper memory 13 stores, instead of the print-control data, selection-designating information indicating the print-control data to be selected (for example, ID of the print-control data to be selected). The printer driver 3 obtains the selection-designating information from the roll-paper memory 13 via the printer 7, and selects, from among the existing print-control data, the print-control data indicated by the selection-designating information.

Hereinafter, specific explanation will be made of the printer driver 3 generating the print data based on these print-control data with reference to FIG. 3.

Figure 3:
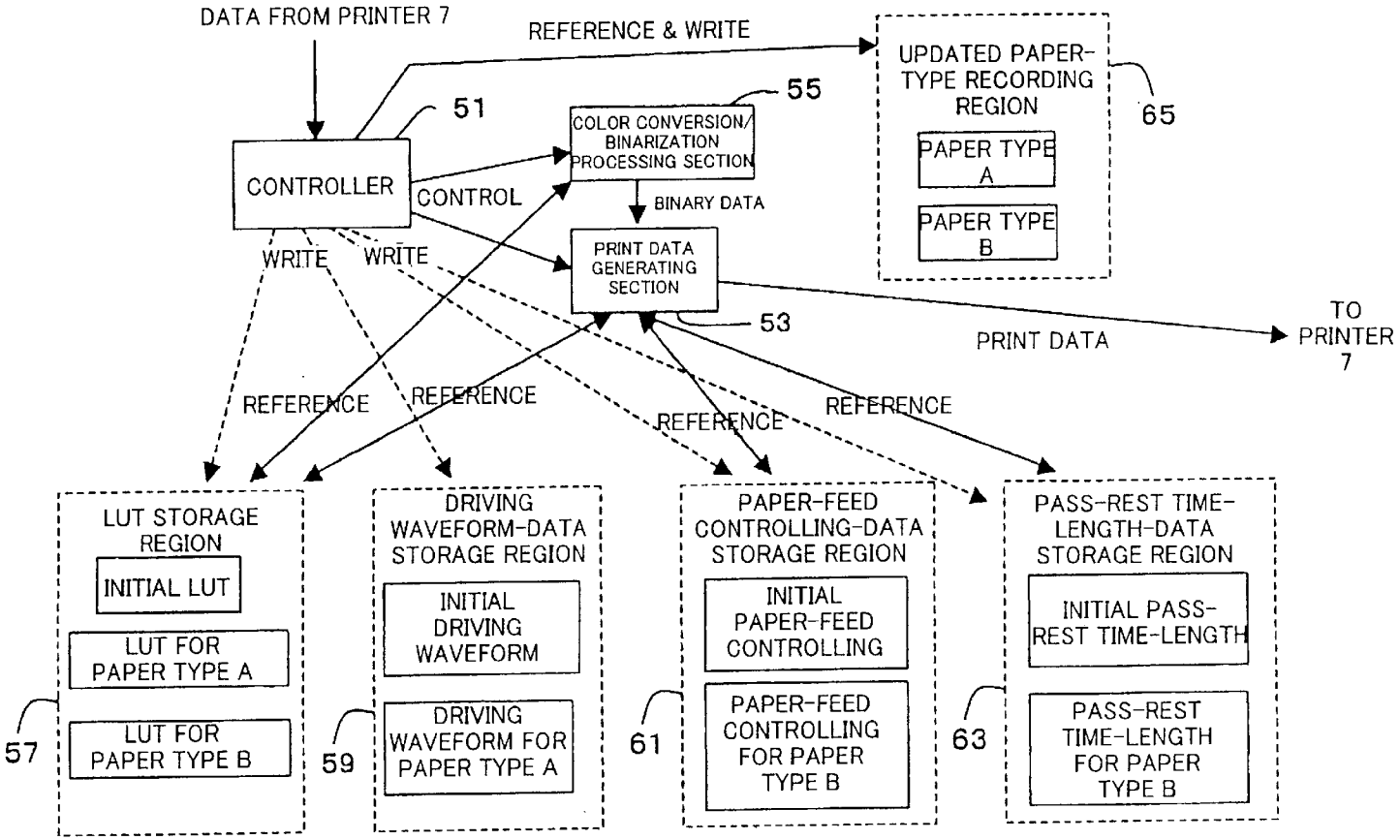
FIG. 3 is a diagram showing a configuration of a printer driver 3.

As shown in FIG. 3, the printer driver 3 comprises: an updated paper-type recording region 65; an LUT storage region 57; a driving-waveform storage region 59; a paper-feed-controlling-data storage region 61; a path-rest time-length storage region 63; a controller 51; a color-conversion/binarization processing section 55; and a print-data generating section 53.

On the updated paper-type recording region 65, there is recorded data indicative of the type of paper corresponding to the print-control data existing in the printer driver 3. If at least one out of the above-mentioned four kinds of the print-control data is stored in the printer driver 3, the paper-type data corresponding to the stored print-control data is recorded on the region 65. By referring to this region 65, it is possible to know which print-control data corresponding to which type of paper already exists in the printer driver 3. (In the shown drawing, with reference to this region 65, it is acknowledged that the print-control data of the paper type A and the paper type B exist in the printer driver 3.)

The LUT storage region 57 is a region in which the LUTs are stored. This region 57 stores, in advance, only LUTs corresponding to a plurality of paper types which have been initially compatible (in other words, from installation of the printer driver 3). (These are hereinafter referred to as initial LUTS.)

Further, the LUT adapted to a new type of paper read-in from the roll-paper memory 13 is added to and stored in this region 57 by the controller 51. It should be noted that there may be a plurality of initial LUTs, or only one as shown in the figure. If there are a plurality of LUTS, for example, a plurality of initial LUTs have contents initially corresponding to the respective plurality of types of paper. If there is one LUT, for example, the initial LUT has a content which is moderately applicable to all of a plurality of initially-adaptable types of paper. This is the same for the initial driving-waveform data, the initial paper-feed controlling data, and the initial pass-rest time-length data.

The driving-waveform-data storage region 59 is a region for storing the driving-waveform data. This region 59 stores, in advance, only driving-waveform data corresponding to paper types which have been initially compatible. (These are hereinafter referred to as initial driving-waveform data.) Further, the driving-waveform data adapted to a new type of paper read in from the roll-paper memory 13 is added to and stored in this region 59 by the controller 51.

The paper-feed-controlling-data storage region 61 is a region storing the paper-feed controlling data. This region 61 stores, in advance, only paper-feed controlling data corresponding to paper types which have been initially compatible. (These are hereinafter referred to as initial paper-feed controlling data.) Further, the paper-feed controlling data adapted to a new type of paper is added to and stored in this region 61 by the controller 51. The paper-feed controlling data is data derived by the controller 51 by correcting the initial paper-feed controlling data based on a parameter recorded on the paper-feed correcting data adapted to the new type of paper read in from the roll-paper memory 13, as will be discussed later.

The pass-rest-time-length-data storage region 63 is a region storing the pass-rest time-length data. This region 63 stores, in advance, only pass-rest time-length data corresponding to paper types which have been initially compatible. (These are hereinafter referred to as initial pass-rest time-length data.) Further, the pass-rest time-length data adapted to a new type of paper read in from the roll-paper memory 13 is added to and stored in this region 63 by the controller 51.

The controller 51 issues an instruction to a printing-process control circuit 11 in the printer 7 to read-in and transfer the paper-type data from the roll-paper memory 13 at a predetermined timing (for example, when the power of the printer 7 is turned on, when an instruction to execute printing is received from the user, or when the roll paper 15 is set on the printer 7, and so forth). The controller 51 analyzes the paper-type data received from the printer 7 in response to the above-mentioned instruction, refers to the updated paper-type region 65, and determines whether the paper-type data received from the printer 7 exists or not (in other words, determines whether or not the paper-type data received from the printer 7 already exists in the updated paper-type region 65).

As a result of the determination, if the paper-type data received from the printer 7 does not exist in the printer driver 3, the controller 51 issues an instruction to the printing-process control circuit 11 in the printer 7 to read-in and transfer all of the print-control data stored in the roll-paper memory 13. Then, the controller stores the print-control data transferred in response to the instruction in predetermined locations. Specifically, the controller 51: stores the LUT in the LUT storage region 57 if an LUT is received from the printer 7; stores the driving-waveform data in the driving-waveform-data storage region 59 if driving-waveform data is received; and stores the pass-rest time-length data in the pass-rest-time-length-data storage region 63 if pass-rest time-length data is received. Further, if the paper-feed correcting data is received from the printer 7, the controller 51 generates paper-feed controlling data adapted to the paper-type data in the roll-paper memory 13 by correcting the existing paper-feed controlling data (for example, the initial paper-feed controlling data) based on a parameter recorded on the paper-feed correcting data. Then the controller stores the generated data in the paper-feed-controlling-data storage region 61. When such process is completed, the controller 51 writes the paper-type data in the roll-paper memory 13 into the updated paper-type region 65.

If the paper-type data received from the printer 7 already exists in the printer driver 3 as a result of the above determination, the controller 51 does not issue the instruction to read-in and transfer all print-control data stored in the roll-paper memory 13.

Further, the controller 51 controls the color-conversion/binarization processing section 55 and the print-data generating section 53 to permit printing according to the type of paper of the roll paper 15. More specifically, the controller 51 instructs the color-conversion/binarization processing section 55 and the print-data generating section 53 to use an existing print-control data if there exists print-control data adapted to the paper-type data in the roll-paper memory 13 (in other words, the paper type of the roll paper 15); and, if print-control data adapted to the paper type does not exist, the controller 51 selects a certain print-control data from the existing print-control data, and instructs the sections 55 and 53 to use the selected print-control data. For example, if an LUT adapted to the paper-type data in the roll-paper memory 13 exists, the controller 51 instructs the color-conversion/binarization processing section 55 and the print-data generating section 53, both of which using LUTS, to use the existing LUT. If the adapted LUT does not exist, the controller 51 selects a certain LUT (for example, the initial LUT) among the existing LUTS (in the shown drawing, the initial LUT, the LUT for paper type A, and the LUT for paper type B) and instructs the sections 55 and 53 to use the selected LUT.

The color-conversion/binarization processing section 55 refers to the LUT (that is, the LUT adapted to the paper-type data in the roll-paper memory 13, or the existing LUT selected by the controller 51) designated by the controller 51, and converts the original image data in the RGB color system having multiple tone (for example, 256-step tone) into image data in the CMYK color system having the same tone. (That is, the section 55 performs color conversion process.) Further, the color-conversion/binarization processing section 55 converts the multiple-tone CMYK image data into binary CMYK image data (that is, one bit word indicating whether a one-pixel single-color component represents a dot or a blank) by such as dithering or error-diffusion method. (That is, the section 55 conducts binarizing.) It should be noted that the flow for converting the original multiple-tone RGB image data into the binary CMYK image data is not limited to the above-mentioned flow.

In other words, as one example, the color-conversion/binarization processing section 55 converts the original multiple-tone RGB image data into a medium-tone RGB original image data (for example, 256-step tone (8 bit) original image data is converted into 16-step tone (4 bit) original image data). At this stage, the section 55 refers to the LUT designated by the controller 51, and converts the color of the medium-tone RGB original image data into the medium-tone CMYK image data. Then, the color-conversion/binarization processing section 55 performs a binarizing process for converting the medium-tone CMYK image data into the binary CMYK image data.

The print-data generating section 53 generates the print data for printing the image expressed by the binary CMYK image data described above based on, for example, the driving-waveform data, the paper-feed controlling data and the pass-rest time-length data designated by the controller 51. Then, the print-data generating section 53 sends the print data to the printer 7. Accordingly, the ink duty, paper-feeding amount, the timing of passing the carriage 21, and so forth of the printer 7 are controlled based on the print data (that is, based on the driving-waveform data, the paper-feed controlling data and the pass-rest time-length data and so forth), thus making it possible to obtain a printing result depending on the type of paper of the roll paper 15.

Figure 4:
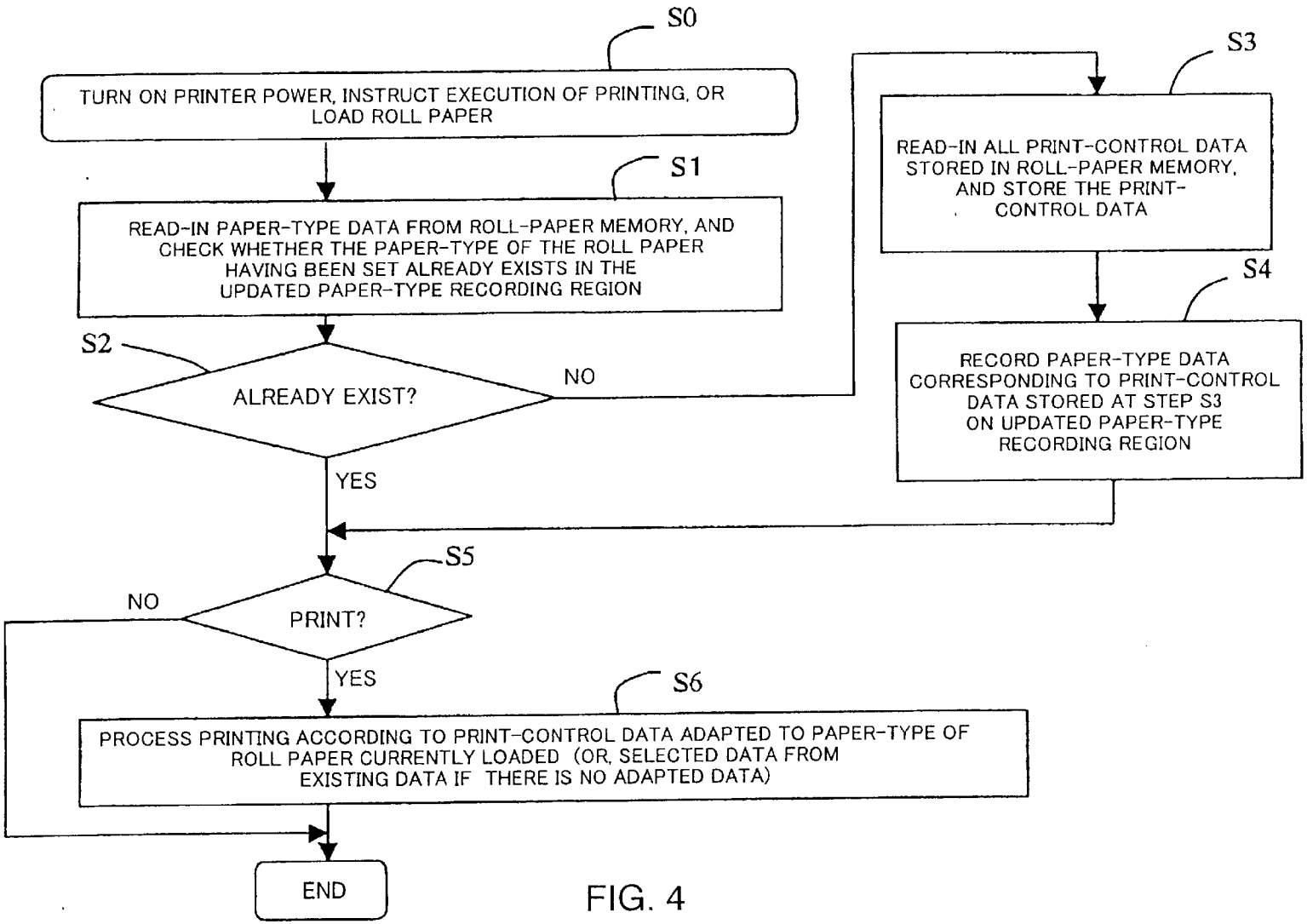
FIG. 4 is a flowchart showing a process flow to be performed in the printing apparatus.

With reference to FIG. 4, the process flow to be executed in the printer driver 3 shown in FIG. 3 will be discussed.

For example, when the power of the printer 7 is turned on, when the printing-execution instruction is received from the user, or when the roll paper 15 is set on the printer 7 (step SO), the printer driver 3 reads-in the paper-type data from the roll-paper memory 13 via the printer 7 to check whether or not the read-in paper-type data already exists. (That is, whether or not the paper-type data received from the printer 7 already exists in the updated paper-type storage region 65 is checked.) (S1).

At step S1, if the read-in paper-type data does not exist in the printer driver 3 (NO at S2), the printer driver 3 reads-in all of the print-control data stored in the roll-paper memory 13 via the printer 7, and stores the read-in print-control data to the predetermined locations (S3). Subsequently, the printer driver 3 writes-in the paper-type data read-in at step S1 to the updated paper-type region 65 (S4). Then, the printer driver 3 performs steps S5 and S6 discussed later.

At step S1, if the read-in paper-type data already exists in the printer driver 3 (YES at S2), the printer driver 3 performs steps S5 and S6 discussed later.

That is, after step S4 or after YES at step S2, if the printing-execution instruction is received from the user (YES at step S5), a printing process (that is, the above-mentioned color-conversion process, the binarizing process, and the print-data generating process) is executed based on the print-control data adapted to the type of paper of the currently-set roll paper 15 (that is, data adapted to the paper-type data in the roll-paper memory 13) (S6). At step S6, if there is a kind of printing control that is not covered by the adapted print-control data, the printer driver 3 selects a replaceable print-control data from among the existing print-control data that kind of printing control, and performs the printing process using the selected print-control data and the above-mentioned adapted print-control data.

It should be noted that the process flow of the printer driver 3 is not limited to the above-mentioned flow. For example, it is possible for the printer driver 3 to perform the printing process at step S6 using the print-control data before storing the print-control data read-in from the roll-paper memory 13 to the predetermined locations, and subsequently, store the print-control data in the predetermined locations.

According to the first embodiment set forth above, the roll-paper memory 13 stores the print-control data adapted to the type of paper (or characteristics) of the roll paper 15. The printer driver 3 obtains the paper-type data in the roll-paper memory 13 via the printer 7, checks whether or not the same data as the paper-type data is stored (in other words, whether or not it already has the print-control data adapted to the type of paper of the roll paper 15). If the obtained paper-type data is not yet stored, the print-control data stored in the roll-paper memory 13 is obtained via the printer 7, and printing is controlled using the obtained data. In this way, the user does not have to take the trouble to, for example, update the printer driver 3 by accessing a predetermined WWW server even when a usable paper type is newly added, and it becomes possible to obtain a printing result adapted to the new type of paper.

Further, in the first embodiment set forth above, the printer driver 3 checks whether or not the same data as the paper-type data in the roll-paper memory 13 is stored. The print-control data stored in the roll-paper memory 13 is obtained via the printer 7 and stored only if the paper-type data is not yet stored. In this way, since unnecessary communication between the host device 1 and the printer 7 can be eliminated, it is possible to expect a effect of preventing lowering of throughput and so forth.

Further, according the first embodiment set forth above, for certain paper types, it is not required to store all of the above-mentioned four kinds of print-control data in the roll-paper memory 13. (In this case, regarding the kind of data not stored, the printer driver 3 performs the printing process by selecting the replaceable print-control data from among the existing print-control data). Therefore, it becomes possible to economize on memory capacity of the roll-paper memory 13.

As set forth above, while several first embodiments preferred in the present invention have been discussed, these are exemplifications for explaining the present invention, and the scope of the present invention is not intended to be limited to only these embodiments. The present invention can be implemented even by other various embodiments.

For example, as a first modification, instead of an LUT, the roll-paper memory 13 can store a color-correction parameter for generating an LUT adapted to the type of paper of the roll paper 15 by correcting respective values of the initial LUT in the printer driver 3. In this case, if the color-correction parameter is received from the printer 7, the printer driver 3 corrects the respective values of the initial LUT using the color-correction parameter to generate the LUT adapted to the type of paper of the roll paper 15, stores the LUT in the LUT storage region 57, and refers to that LUT as required in the subsequent printing process.

Further, as a second modification, instead of paper-feed correcting data, the roll-paper memory 13 may store the paper-feed controlling data which is to be obtained based on the paper-feed correcting data.

Further, as a third modification, the foregoing various functions of the printer driver 3 may be installed to the printer 7, and the printer 7 may execute the process flow shown in FIG. 4.

Next, a second embodiment of the present invention will be discussed in detail with reference to FIG. 5 through FIG. 11.

Figure 5:
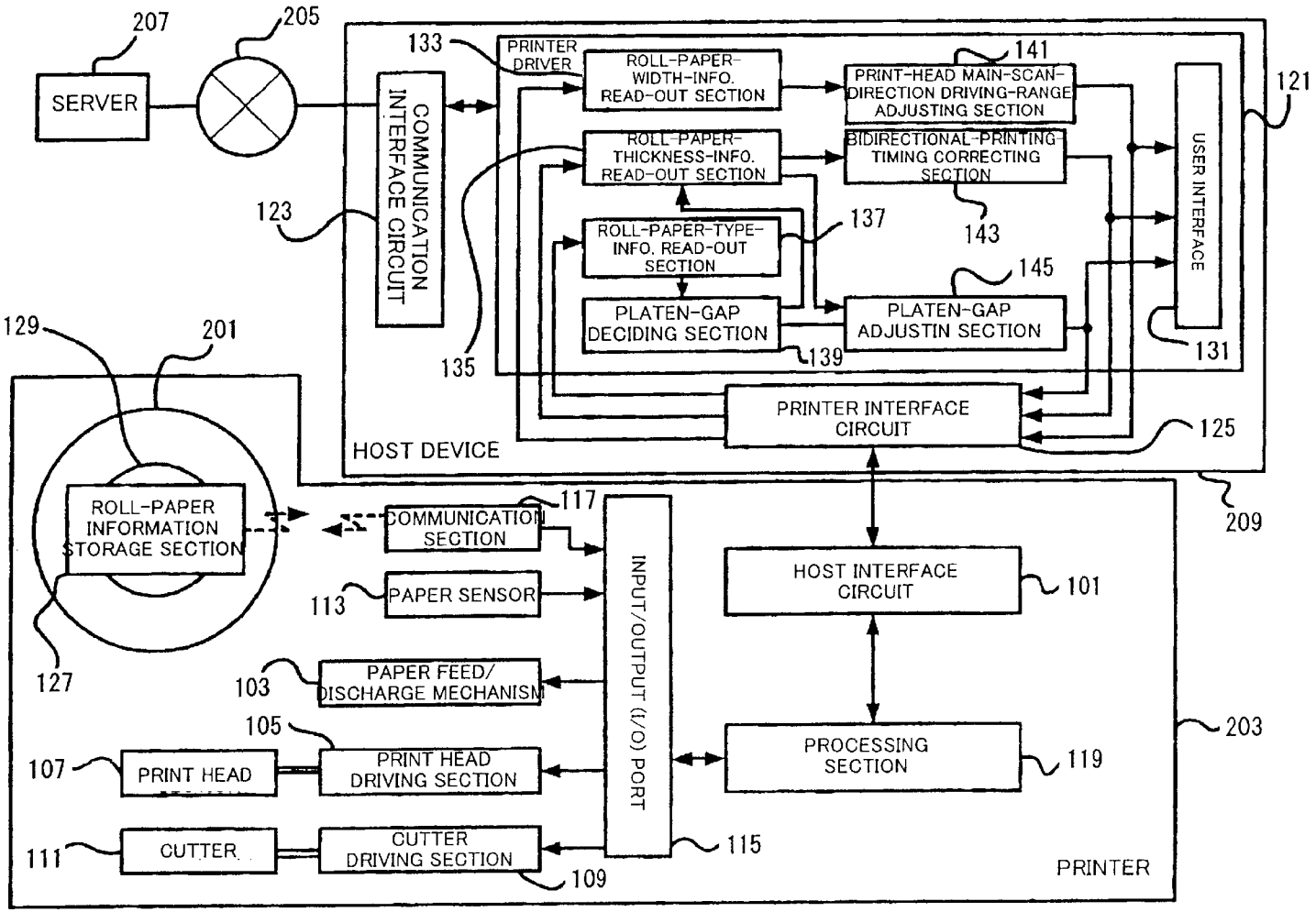
FIG. 5 is a block diagram including an overall configuration of a printing system for a rolled printing medium according to a second embodiment of the present invention.

FIG. 5 is a block diagram showing an overall construction of a printing system for a rolled printing medium according to one embodiment of the present invention.

As shown in FIG. 5, the foregoing system comprises a printer unit 203 and a host device 209. The printer unit 203 conducts a printing process to a roll paper 201, which is the printing paper. The host device 209 forms a client-server system with a server 207 connected via a communication network (e.g. Internet or the like) 205. The printer unit 203 comprises: a host interface (host IF) circuit 101; a paper feeding/discharging mechanism 103; a print head driving section 105; a print head 107; a cutter driving section 109; a cutter 111; a paper sensor 113; an input/output (I/O) port 115; a communication section 117; and a processing section 119 as an internal CPU of the printer unit 203. On the other hand, the host device 209 comprises: a printer driver 121 installed as a program module for controlling the printer; a communication interface (communication IF) circuit 123; and a printer interface (printer IF) circuit 125.

In the printer unit 203, the host IF circuit 101 relays transmission and reception of various information for the printing process between the processing section 119 and the printer driver 121 through the printer IF circuit 123 (in the host device 209). The paper feeding/discharging mechanism 103 has a pair of paper-feed rollers provided on the side of a space for loading the roll paper 201, and a pair of paper-discharging rollers located downstream of the print head 107. In the paper feeding/discharging mechanism 103, the above-mentioned pair of paper-feed rollers rotates based on a control signal output from the processing section 119 via the I/O port 115, and the roll paper 201 is guided through a gap between the opposing print head 107 and the platen and towards the pair of paper-discharge rollers. Conversely to this operation, under control of the processing section 119, the paper feeding/discharging mechanism 103 also appropriately carries out an operation of pulling back the roll paper 201, in which a printing-processed section has been cut off, from the opposing gap each time the printing process for one page unit is finished. The print head 107 performs printing of the image information to the roll paper 201 based on a control signal output from the processing section 119 via the I/O port 115 to the print-head driving section 105. The cutter 111 is driven based a control signal output from the processing section 119 to the cutter driving section 109 via the I/O port 115, and cuts between the printed portion of the roll paper 201 and the not-printed portion. The paper sensor 113 is provided in the vicinity of the above-mentioned pair of paper-feed rollers in the feeding passage of the roll paper 201. The sensor 113 outputs a predetermined detection signal to the processing section 119 via the I/O port 115 when it detects the leading edge of the roll paper 201. The communication section 117 relays reading-out of the information (detail will be discussed later) relating to the corresponding roll paper 201 by the printer driver 121 (of the host device 209) from the roll-paper-information storage section 127 by performing radio communication with the roll-paper-information storage section 127, which is discussed hereinafter, under control of the processing section 119. The foregoing information received by the communication section 117 is transmitted to the printer driver 121 through the I/O port 115, the processing section 119, the host IF circuit 101, and the printer IF circuit 125.

The roll paper 201 is supplied through the loading space provided in the printer unit 203. A roll-paper-information storage section 127 is detachably or fixedly arranged on the inner peripheral surface of a core 29 of the roll paper. A memory, or a so-called non-contacting type memory, having a construction for reading out information (detailed will be discussed later) relating to the roll paper 201 from the storage section 127 by the printer driver 121 (of the host device 209) via radio communication between the communication section 117 of the printer unit 203 and the storage section 127, is adopted for the roll-paper-information storage section 127. This memory comprises, for example: an erasable non-volatile semiconductor memory element, such as an $E^2$PROM; a power supply section for supplying power to the memory element; and a communication section for performing radio communication with the communication section 117 of the printer unit 203 (all of the above are not shown).

In the semiconductor memory, there are stored, as information relating to the corresponding roll paper 201: information relating to a thickness of the roll paper 201 (paper-thickness information) (0.4, 0.6, 0.8, 1.0 (mm)); information relating to a width of the roll paper 201 (paper-width information) (the corresponding width of printing papers in either A5, B5, A4, B4, A3 sizes); and information relating to the type of the roll paper 201 (type information) (for example, plain paper, super-fine paper, photo paper, OHP film, glossy paper, and so forth). The paper-thickness information, the paper-width information, and the type information will be discussed in detail later on. The power supply section is constructed capable of using, for example, induced electromotive force as a power source generated by the foregoing radio communication (the radio wave transmitted from the printer unit 203). The communication section: receives an information-read-out request from the printer driver 121 by performing radio communication with the communication section 117 of the printer unit 121; extracts the information corresponding to the request from the plurality of kinds of information being stored; and transmits the information to the communication section 117 of the printer unit 203.

In the host device 209, the communication IF circuit 123 relays transmission and reception of various information relating to the printing process carried out between the printer driver 121 and the server 207 via the communication network 205. The printer IF circuit 125 relays transmission and reception of various information for the printing process carried out between the printer driver 121 and the processing section 119 through the host IF circuit 101 (of the processing section 119).

The printer driver 121 performs processing operations of, for example, generating the print data, determining the order of transferring the generated print data to the printer unit 203, and so forth. The printer driver 121 also comprises: a user IF 131; and a program to be appropriately downloaded from the server 207 and having the following functions as the program for the printing process of the roll paper 201. The functions that the program comprises may be expressed by the respective blocks: a section 133 for reading out the roll-paper-width information; a section 135 for reading out the roll-paper-thickness information; a section 137 for reading out the roll-paper-type information; a platen-gap deciding section 139; a section 141 for adjusting the driving range of the print head in the main-scanning direction; a section 143 for correcting the bidirectional printing timing; and a platen-gap adjusting section 145. Hereinafter, for simplification, the foregoing blocks are respectively referred to as: the paper-width-information reading-out section 133; the paper-thickness-information reading-out section 135; the type-information reading-out section 137; the deciding section 139; the driving-range adjusting section 141; the correcting section 143; and the PG adjusting section 145.

When a result of adjustment of the driving range of the print head 107 in the main-scanning direction is applied from the driving-range adjusting section 141, the user IF 131 displays the image information generated based on the adjustment result on a display (not shown) of the host device 209. When a result of correction of the timing upon bidirectional printing is applied from the correcting section 143, or when a result of adjustment of the platen gap is applied from the PG adjusting section 145, the user IF 131 executes a processing operation similar to the above.

The paper-width-information reading-out section 133 transmits, to the processing section 119 via the printer IF circuit 125 and the host IF circuit 101, a request to read-out the paper-width information of the roll paper 201 which is loaded onto the loading space, and thereby receives the foregoing paper-width information transmitted from the roll-paper-information storage section 127 via the communication section 117, the I/O port 115, the processing section 119, the host IF circuit 101, and the printer IF circuit 125. As is clear from the content of the foregoing explanation, the paper-width information indicates to which of the paper-width sizes, for example, A3, B4, A4, or B5 the paper width of the corresponding roll paper 201 applies. This paper-width information is output from the paper-width-information reading-out section 133 to the driving-range adjusting section 141.

Likewise, the paper-thickness reading-out section 135 transmits, to the processing section 119 via the information-transmission passage (the printer IF circuit 125, the host IF circuit 101, and so forth), a request to read out the paper-thickness information, and thereby receives the foregoing paper-thickness information transmitted from the roll-paper-information storage section 127 via the information-transmission passage. As set forth above, this paper-thickness information indicates to which of the values, for example, 0.4, 0.6, 0.8, or 1.0 (mm) the paper width of the corresponding roll paper 201 applies. This paper-thickness information is output from the paper-thickness-information reading-out section 135 to the correcting section 143. It should be noted that, when a command to read-out the paper-thickness information is output from the deciding section 139, the paper-thickness information having been read into the paper-thickness-information reading-out section 135 from the roll-paper-information storage section 127 via the foregoing information transmission passage is output to the PG adjusting section 145, and is not output to the correcting section 143.

The type-information reading-out section 137 transmits, to the processing section 119 through the foregoing information transmission passage, a request to read out the above-mentioned type information, and thereby receives the foregoing type information transmitted from the roll-paper-information storage section 127 via the foregoing information transmission passage, similar to the foregoing paper-width-information reading-out section 133 or the paper-thickness-information reading-out section 135. As set forth above, the type information indicates to which of the types, for example, plain paper, super-fine paper, photo paper, OHP film, or glossy paper the corresponding roll paper 201 applies. This type information is output from the type-information reading-out section 137 to the deciding section 139.

The driving-range adjusting section 141 identifies to which of the paper-width sizes A3, B4, A4, or B5 the width of the corresponding roll paper 201 applies. Then, according to the result of identification, the adjusting section 141 outputs a predetermined signal for instructing control of the print head to the processing section 119 via the printer IF circuit 125 and the host IF circuit 101 so as to automatically adjust the driving range of the print head 107 in the main-scanning direction via the processing section 119, and also, notifies the result of the automatic adjustment to the user IF 131.

The correcting section 143 identifies to which of the values among 0.4, 0.6, 0.8, 1.0 (mm) the thickness of the corresponding roll paper 201 applies based on the paper-thickness information input from the paper-thickness-information reading-out section 135. Then, according to the result of identification, the correcting section 143 outputs a predetermined signal for instructing correction of the actuating timing to the processing section 119 via the printer IF circuit 125 and the host IF circuit 101 so as to correct, via the processing section 119, the actuating timing of the print head 107 during its returning motion to be an appropriate timing in view of the actuating timing during its forward motion, and also, notifies the result of correction to the user IF 131.

The deciding section 139 identifies to which of the types among plain paper, super-fine paper, photo paper, OHP film, or glossy paper (the type of) the corresponding roll paper 201 applies. Then, based on the result of identification, the deciding section 139 determines whether the paper quality of the roll paper 201 is a type requiring expansion of the platen gap, in other words, whether the paper quality is such that can cause grazing of the paper to the print head 107 unless the platen gap is adjusted to be expanded because creases are likely to be formed by the ink ejected from the print head 107. If it is determined that the paper quality is such that can cause grazing, the deciding section 139 outputs the determination result to the PG adjusting section 145, and outputs an instruction to the paper-thickness-information reading-out section 135 to read-out the paper-thickness information.

The PG adjusting section 145 is actuated according to the input from the deciding section 139 of the result of determination that the paper quality causes grazing, and reads out from the paper-thickness-information reading-out section 135 the paper-thickness information (that is, information indicative of the paper thickness of the corresponding roll paper 201, for example, any value of 0.4, 0.6, 0.8, 1.0 (mm)). Then, based on the read paper-thickness information, the adjusting section 145 outputs a predetermined signal for instructing adjustment to the processing section 119 via the printer IF circuit 125 and the host IF circuit 101 for making the processing section 119 automatically adjust the value of the platen gap to an extent in which the grazing with the print head 107 due to formation of creases on the roll paper 201 is not caused. Also, the result of the foregoing adjustment is notified to the user IF 131.

It should be noted that the automatic adjustment of the platen gap by the foregoing PG adjusting section 145 via the processing section 119 may be performed according to a plurality of stages: a stage performed with relatively low precision, and a stage performed with a relatively high precision.

Figure 6:
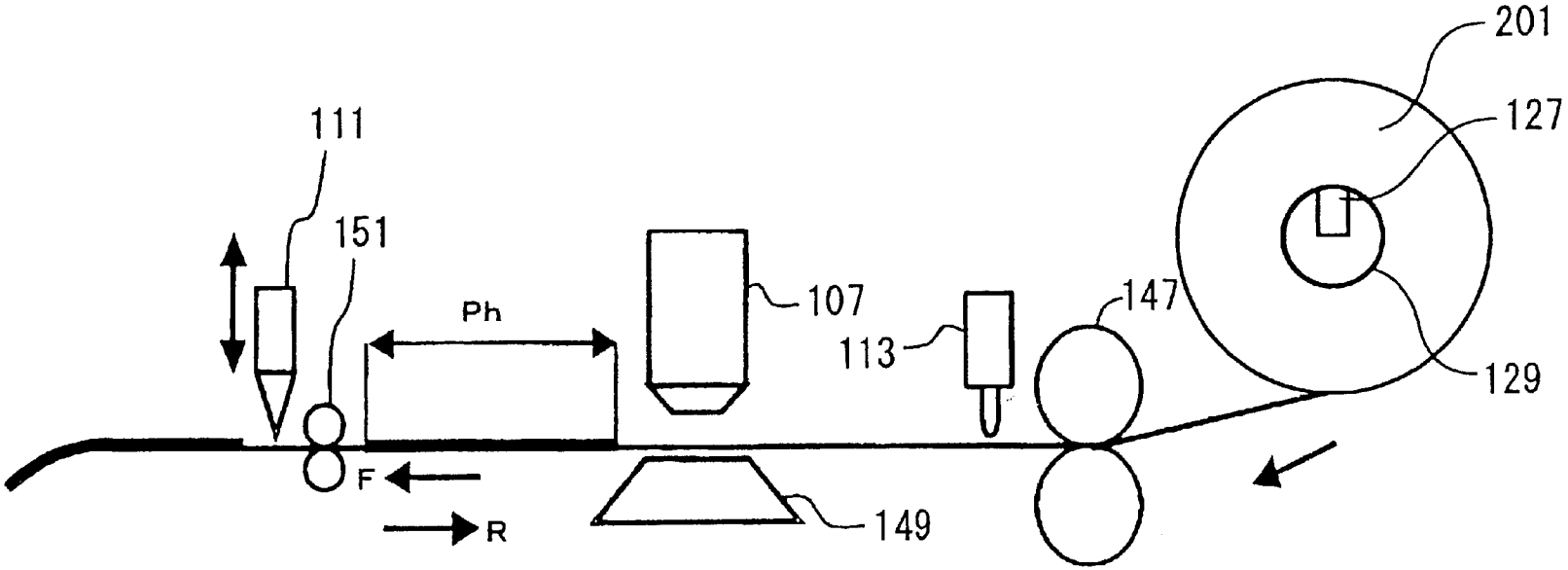
FIG. 6 is an explanatory diagram showing a mechanical constructional portion inside of the printer included in the printing system shown in FIG. 5.

FIG. 6 is an explanatory illustration showing mechanical components within the printer included in the printing system illustrated in FIG. 5.

In FIG. 6, the foregoing roll paper 201 is loaded by the user onto a predetermined position (that is, the foregoing loading space) in the printer unit 203, or loaded onto a device separately constructed from the printer unit 203. The paper-feed roller 147 is constructed for rotation in forward and reverse directions. For example, when a driving roller located on the upper side in the drawing is rotated in the forward direction (and when the driven roller located on the lower side in the drawing is rotated in reverse direction), the paper-feed roller 147 carries the roll paper 201 in a direction of arrow F. On the contrary, when the driving roller is rotated in the reverse direction (and when the driven roller is rotated in forward direction), the paper-feed roller 147 carries the roll paper 201 in the direction of arrow R. The paper sensor 113 is arranged in the vicinity of the paper-feed roller 147 downstream in the paper-feeding direction, and when the sensor 113 detects the leading edge of the roll paper 201 in the feeding direction by the forward rotation of the driving roller, the sensor 113 outputs a predetermined electric signal to the processing section 119 through the I/O port 115 (both are shown in FIG. 5).

When the roll paper 201 is carried by the forward rotation of the driving roller to the gap between the opposing print head 107 and the platen 149 that supports the roll paper 201 from its back surface, the predetermined printing process is performed in respect to the roll paper 201 according to the print image data transferred from the host device 209 to the processing section 119. By passing through the opposing gap, a printed page shown by the reference sign Ph is formed in the predetermined region of the roll paper 201. This page Ph includes the printed image and margins formed on both ends of the image data in the transporting direction. The paper-discharge roller 151 discharges the roll paper 201 out of the printer unit 203. The cutter 111 is arranged in the vicinity of the paper-discharge roller 151 downstream in the paper-feeding direction, and cuts off the printed page Ph from the roll paper 201 in order to provide to the roll paper 201 a break in usage.

In accordance with the cutting, the page Ph is discharged from the printer unit 203. The roll paper 201 is carried (or pulled back) in the direction of arrow R up to the position where the leading edge of the roll paper 201 after cutting is detected by the paper sensor 113 by reverse rotation of the driving roller.

Figures 7, 8:
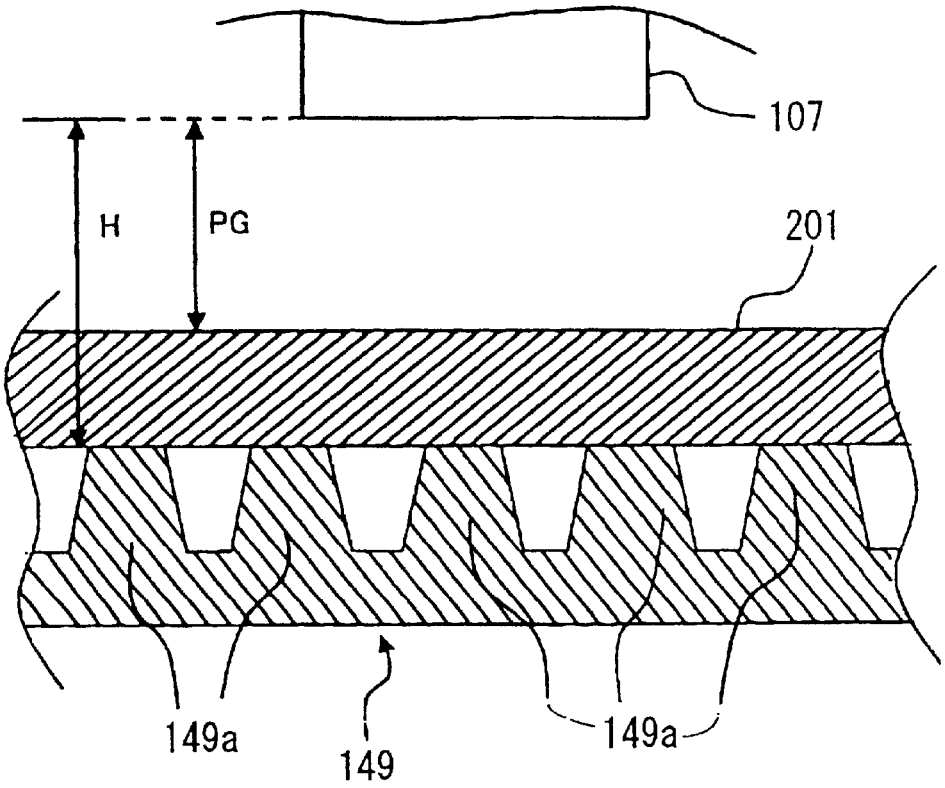
FIG. 7 is an explanatory diagram showing a relationship between a platen gap and a head height.
FIG. 8 is an explanatory diagram showing one example of a table stored in a roll-paper-information storage section shown in FIG. 5 and FIG. 6.

FIG. 7 is an explanatory diagram showing a relationship between the platen gap and the head height.

As shown in FIG. 7, the platen gap (PG) means a relationship between a printing surface (bottom surface) of the print head 107 and a surface of the printing paper (in this embodiment, the roll paper 201). The head height (H) means a clearance between the printing surface (bottom surface) of the print head 107 and upper surfaces of a plurality of diamond ribs 149*a* arranged at substantially equal intervals on the upper surface of the platen 149 (or, the bottom surface of the roll paper 201). The foregoing platen gap (in other words, the head height) is variably adjusted in the manner set forth above by the foregoing PG adjusting section 145 and the processing section 119. It should be noted that the initial value of the head height (H) is set at, for example, 1.94 mm.

FIG. 8 is an explanatory diagram showing one example of the table to be stored in the roll-paper-information storage section 127 shown in FIG. 5 and FIG. 6.

In the example shown in FIG. 8, "premium" is recorded on the paper-type column, "0.8 mm" is recorded on the paper thickness column, and "4 inch" is recorded on the paper width column, respectively. In other words, a premium-type paper having a paper thickness of 0.8 mm and a paper width of 4 inch is loaded as the roll paper 201 onto the foregoing loading space of the printer unit 203.

FIG. 9 is an explanatory diagram relating to an actuating timing of the print head upon bidirectional printing, and FIG. 10 is an explanatory diagram relating to adjustment of the platen gap.

In the actuating-timing setting of the print head in the bidirectional printing shown in FIG. 9, since the head height is constant (1.94 mm), the platen gap decreases to 1.54, 1.34, 1.14, 0.94 (mm) according to the increase of the paper thickness to 0.4, 0.6, 0.8, 1.0 (mm). Therefore, in order to comply with the variation of the platen gap, there is a need to change a timing-set value as 1, 2, 3, or 4. On the other hand, a table (not shown) that correlates the timing-set value and an amount to be delayed from a reference timing is provided in advance. The print head is driven at the timing delayed from the reference timing based on the delay amount corresponding to the timing-set value. For example, when the timing-set value derived from the platen gap is 1, and the timing-set value 1 and a delay amount $1/1440$ inches are correlated in the table, the print head is actuated at a timing delayed $1/1440$ inch from the reference timing. It should be noted that the table may be such that correlates the timing-set value and the actuating timing of the print head.

On the other hand, according to correction of the platen gap shown in FIG. 10, the value of the platen gap is controlled to be constant at 1.14 (mm) irrespective of the paper thickness. Therefore, when the paper thickness is 0.4 and the gap value is 1.54, the correction value of the foregoing gap is −0.4; when the paper thickness is 0.6 and the gap value is 1.34, the correction value of the foregoing gap is −0.2; when the paper thickness is 0.8 and the gap value is 1.14, the correction value of the foregoing gap is ±0; and when the paper thickness is 1.0 and the gap value is 0.94, the correction value of the foregoing gap is +0.2. It should be noted that according to this correction, the type of the roll paper 201 is not considered. That is, according to this correction, it is not considered whether the roll paper 201 has a paper quality that easily forms creases due to the ink ejected from the print head 107 and therefore causes grazing with the print head 107.

In the actuating-timing correction (FIG. 9) of the print head upon bidirectional printing and in the platen-gap correction (FIG. 10), the head height is constant. However, in a control for avoiding grazing of the creases with the print head 107 due to formation of creases in the roll paper 201, the head height is variably adjusted according to the paper thickness in order to set the platen gap to a predetermined value in order to prevent grazing.

Figure 11:
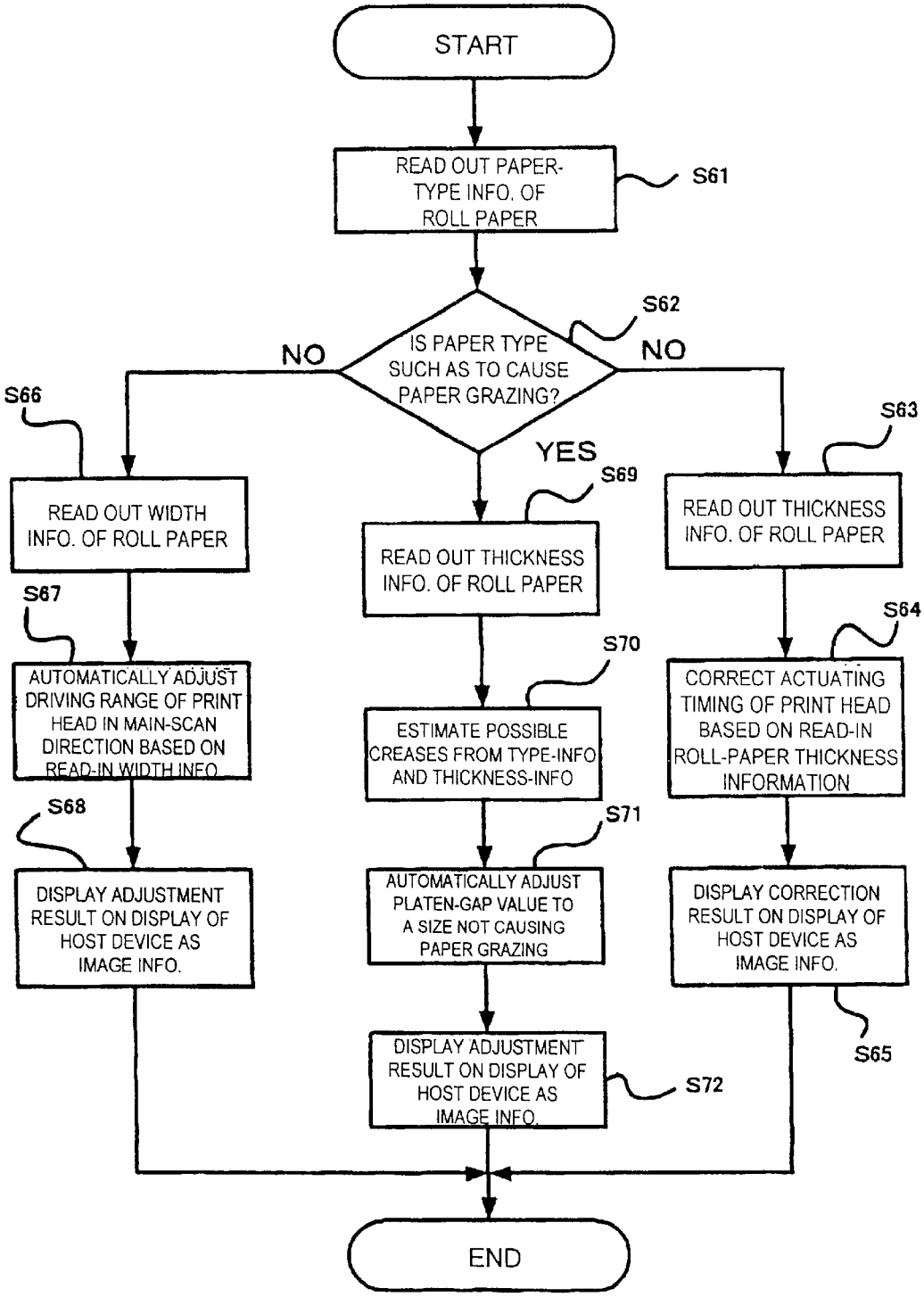
FIG. 11 is a flowchart showing process operations upon adjustment of a driving range of the print head in the main-scanning direction at respective portions shown in FIG. 5, correction of a bidirectional printing timing, and adjustment of the platen gap.

FIG. 11 is a flowchart showing processing operations by the respective portions illustrated in FIG. 5 upon adjustment of the driving range of the print head 107 in the main-scanning direction; correction of actuating timing of the print head upon bidirectional printing; and platen-gap adjustment.

In FIG. 11, first, the type information is read out from the roll-paper-information storage section 127 (step S61). On the basis of the type information, determination is made on whether or not the paper quality of the corresponding roll paper 201 is such that may cause grazing with the print head 107 unless the platen gap is adjusted to be expanded (step S62). As a result of this determination, if the paper quality is such that will not cause grazing (YES at step S62), then the paper-thickness information is read out from the roll-paper-information storage section 127 (step S63) for correcting the actuating timing of the print head 107 upon bidirectional printing based on the paper-thickness information (step S64). The result of correction is displayed as image information on the display (not shown) of the host device 209 (step S65). Along with the processes shown in steps S63 to S65, the paper-width information is read out from the roll-paper-information storage section 127 (step S66). On the basis of the paper-width information, the driving range of the print head 107 in the main-scanning direction is automatically adjusted (step S67). The result of adjustment is displayed as image information on the display (not shown) (step S68).

On the other hand, if the result of determination is that the paper quality will cause grazing (NO at step 62), next, the paper-thickness information is read out from the roll-paper-information storage section 127 (step S69), and, according to the type information read out at step S61 and the paper-thickness information, estimation is made on what kind of creases can be formed in the corresponding roll paper 201 (step S70). Then, based on this result of estimation, the value of the platen gap is automatically adjusted to a size that will not cause grazing (step S71), and the result of adjustment is displayed as image information on the foregoing display (not shown) (step S72).

As explained above, with one embodiment of the present invention, since the actuating timing of the print head 107 upon bidirectional printing is automatically adjusted so as to adapt to the paper thickness of the roll paper 201 loaded onto the printer unit 203, high-quality bidirectional printing can be performed for the roll paper 201. Further, occurrence of discrepancy between the width of the roll paper 201 and the set drive range of the print head 107 in the main-scanning direction can be prevented. Furthermore, grazing of paper with the print head 107 due to creases formed on the roll paper 201 can be avoided.

Note that the program for the printing process on the roll paper 201 having functions as the foregoing paper-width-information reading-out section 133, the paper-thickness-information reading-out section 135, the type-information reading-out section 137, the deciding section 139, the driving-range adjusting section 141, the correcting section 143, and the PG adjusting section 145 is adapted to be appropriately downloaded from the server 207 to the user's host device 209. Accordingly, even if paper according to any standard is used as the roll paper 201, a program adapted to the roll paper 201 can be downloaded from the server 207 to the host device 209. Therefore, by actuating the program, the printer driver 121 may appropriately control the printer unit 203.

Further, a business corporation that manages the server 207 may add-up service points for the user each time the program adapted to the roll paper 201 loaded onto the printer unit 203 is downloaded to the user's host device 209. Accordingly, it becomes possible to provide various services to the user that has obtained a given number of points from the business corporation.

While the preferred second embodiment of the present invention has been explained, this is an example for explaining the present invention, and is not intended to specifically limit the scope of the invention to the shown embodiment. The present invention may be implemented in other various modes.

For example, in the foregoing second embodiment, if it is determined, as a result of the estimation of the possible creases on the roll paper 201 at step S70, that an adjustment of the platen gap is necessary for avoiding grazing, before automatic adjustment of the platen gap at step S71, a step may be provided to make a window with a message containing the determination result pop-up on the display (not shown) of the host device 209. The above goes the same for the case in which it is determined at step S70 that correction of the actuating timing of the print head upon bidirectional printing is needed, in case correction of the actuating timing of the print head upon bidirectional printing is to be carried out instead of adjustment of the platen gap.

As set forth above, according to the second embodiment, it becomes possible to avoid occurrence of discrepancy between the width of the rolled printing medium used in the printing system and the set drive range of print head in the main-scanning direction.

Further, according to the second embodiment, it becomes possible to avoid grazing of paper with the print head due to creases formed on the rolled printing medium used in the printing system.

Furthermore, according to the second embodiment, high-quality bidirectional printing can be performed for the rolled printing medium.

What is claimed is:

1. A printing apparatus for printing on a printing medium comprising:

a printing medium having a storage element to which print-control information adapted to a type of said printing medium is stored;

print-control information provided in advance;

identifying means for identifying said type of said printing medium being set;

determining means for determining whether or not print-control information adapted to said type of said printing medium identified by said identifying means is included in said print-control information provided in advance; and controlling means for controlling printing according to a result of determination by said determining means using either:

said print-control information provided in advance, or said print-control information stored in said storage element.

2. A printing apparatus according to claim 1 further comprising holding means for reading in and holding said print-control information stored in said storage element provided on said printing medium being set.

3. A printing apparatus according to claim 2, wherein, said determining means also determines whether or not print-control information adapted to said type of said printing medium having been identified is already included in said print-control information held in said holding means; and according to said result of determination by said determining means, said controlling means controls printing using any one of:

said print-control information provided in advance;

said print-control information held in said holding means; or said print-control information stored in said storage element provided on said printing medium being currently set.

4. A printing apparatus according to claim 2, wherein printing is controlled using a plurality of kinds of print-control information respectively used at different stages of printing control;

wherein some kinds among said plurality of kinds of said print-control information are stored in said storage element and other kinds of said print-control information are not stored; and wherein when said controlling means uses said print-control information stored in said storage element according to said result of determination by said determining means, said controlling means uses said print-control information stored in said storage element for said some kinds; and said print-control information provided in advance, or said print-control information held in said holding means for said other kinds.

5. A printing apparatus according to claim 1, wherein said print-control information stored in said storage element includes at least one kind of information among:

(1) image-conversion information for converting image data;

(2) ink-adhesion-controlling information for controlling an amount of ink adhering to said printing medium;

(3) medium-feed-controlling information for controlling an amount of said printing medium to be fed;

(4) ink-drying-period information for controlling a period of time for drying said ink adhering to said printing medium, or includes information necessary for obtaining at least one kind of said information of said (1) to (4).

6. A printing apparatus for printing on a printing medium comprising:

identifying means for identifying a type of said printing medium being used;

read-in means for reading in medium-feed-controlling information adapted to said type of said printing medium identified by said identifying means from a location to which said medium-feed-controlling information is stored, said medium-feed-controlling information being information adapted to said type of said printing medium and for controlling an amount of said printing medium to be fed; and controlling means for controlling said amount of said printing medium to be fed based on said medium-feed-controlling information read in by said read-in means.

7. A printing apparatus according to claim 6, wherein, said printing apparatus can exchangeably be set with a rolled printing medium which is a continuous printing medium being rolled up;

said rolled printing medium includes a storage element;

said medium-feed-controlling information adapted to a type of said rolled printing medium is stored in said storage element; and said read-in means reads in said medium-feed-controlling information from said storage element of said rolled printing medium being set to said printing apparatus.

8. A storage element which can be provided on a printing medium, said storage element storing information, wherein, said information is print-control information adapted to a type of said printing medium, and includes at least one kind of information among:

(1) image-conversion information for convening image data;

(2) ink-adhesion-controlling information for controlling an amount of ink adhering to said printing medium;

(3) medium-feed-controlling information for controlling an amount of said printing medium to be fed; and (4) ink-drying-period information for controlling a period of time for drying said ink adhering to said printing medium, or includes information necessary for obtaining at least one kind of said information of said (1) to (4).

9. A printing method for printing on a printing medium comprising a storage element, said method comprising the steps of:

identifying a type of said printing medium being set to a printing apparatus;

determining whether or not print-control information adapted to said type of said printing medium having been identified is included in print-control information provided in advance in said printing apparatus; and controlling printing according to a result of said determination using either:

said print-control information provided in advance, or print-control information stored in said storage element and adapted to said type of said printing medium having been identified.

10. A printing method for printing on a printing medium comprising the steps of:

identifying a type of said printing medium being used in a printing apparatus;

reading in medium-feed-controlling information adapted to said type of said printing medium having been identified from a location to which said medium-feed-controlling information is stored, said medium-feed-controlling information being information adapted to said type of said printing medium and for controlling an amount of said printing medium to be fed; and controlling said amount of said printing medium to be fed based on said medium-feed-controlling information having been read in.

11. A storing medium on which a computer program is recorded readable to a computer, said computer program making said computer execute the following steps of:

identifying a type of a printing medium being set to a printing apparatus, said printing medium comprising a storage element;

determining whether or not print-control information adapted to said type of said printing medium having been identified is included in print-control information provided in advance in said printing apparatus; and controlling printing according to a result of said determination using either:

said print-control information provided in advance, or print-control information in said storage element.

12. A memory provided on a recording medium comprising:

information relating to a thickness of said recording medium; and information relating to a type of said recording medium.

13. A memory according to claim 12, wherein said memory further comprises information relating to a width of said recording medium.

14. A memory according to claim 12, wherein said information relating to said thickness is read out for adjusting an actuating timing of a print head so as to adapt to said thickness upon bidirectional printing.

15. A memory according to claim 13, wherein said information relating to said width is read out for adjusting a driving range of said print head in a main-scanning direction.

16. A memory according to claim 12, wherein, said information relating to said type is read out for deciding whether or not an adjustment of a gap between a print head and said recording medium is necessary; and if it is decided that said adjustment is necessary based on said type, said information relating to said thickness is read out for adjusting said gap or for adjusting a timing to actuate said print head so as to adapt to said thickness.

17. A recording medium comprising:

a rolled medium; and a memory storing information relating to a thickness of said medium and information relating to a type of said medium.

18. A printing system for printing on a recording medium comprising:

said recording medium having medium-information storing means for storing information relating to said medium;

reading-out means for reading out information relating to a thickness of said medium from said medium-information storing means; and adjusting means for adjusting an actuating timing of a print head upon bidirectional printing based on said information relating to said thickness having been read out.

19. A printing system according to claim 18, wherein, said reading-out means and said adjusting means are a program set in a host device; and said program is appropriately downloaded from a server to said host device via a communication network.

20. A printing system for printing on a recording medium comprising:

said recording medium having medium-information storing means for storing information relating to said recording medium;

reading-out means for reading out information relating to a width of said medium from said medium-information storing means; and adjusting means for adjusting a driving range of a print head in a main-scanning direction based on said information relating to said width having been read out.

21. A printing system according to claim 20, wherein, said reading-out means and said adjusting means are a program set in a host device; and said program is appropriately downloaded from a server to said host device via a communication network.

22. A printing system for printing on a recording medium comprising:

said recording medium having medium-information storing means for storing information relating to said recording medium;

medium-type-information reading-out means for reading out information relating to a type of said recording medium from said medium-information storing means;

medium-thickness-information reading-out means for reading out information relating to a thickness of said recording medium from said medium-information storing means;

deciding means for deciding whether or not adjustment of an actuating timing of a print head upon bidirectional printing is necessary based on said information relating to said type having been read out; and adjusting means for adjusting said actuating timing of said print head upon said bidirectional printing based on said information relating to said thickness having been read out, if it is decided that said adjustment is necessary.

23. A printing system for printing on a recording medium comprising:

said recording medium having medium-information storing means for storing information relating to said recording medium;

medium-type-information reading-out means for reading out information relating to a type of said recording medium from said medium-information storing means;

deciding means for deciding whether or not adjustment of a gap between a print head and said medium is necessary based on said information relating to said type having been read out; and adjusting means for adjusting said gap based on said information relating to said type having been read out, if it is decided that said adjustment is necessary.

24. A printing system according to claim 23, wherein said adjusting means adjusts said gap according to a plurality of stages including: a stage performing adjustment with relatively low precision; and a stage performing adjustment with relatively high precision.

25. A printing method for printing on a recording medium comprising the steps of:

reading out information relating to a thickness of said recording medium from storage means provided on said recording medium; and adjusting an actuating timing of a print head upon bidirectional printing based on said information relating to said thickness having been read out.

26. A printing method for printing on a recording medium comprising the steps of:

reading out information relating to a type of said recording medium from storage means provided on said recording medium;

reading out information relating to a thickness of said medium from said storage means;

deciding whether or not an adjustment of a gap between a print head and said medium is necessary based on said information relating to said type having been read out; and if it is decided that said adjustment is necessary, adjusting an actuating timing of said print head upon bidirectional printing based on said information relating to said thickness having been read out.

27. A printing method for printing on a recording medium comprising the steps of:

reading out information relating to a type of said recording medium from storage means provided on said recording medium;

based on said information relating to said type having been read out, deciding whether or not an adjustment of a gap between a print head and said medium, or an adjustment of an actuating timing of said print head upon bidirectional printing is necessary; and if it is decided that said adjustment is necessary, notifying a message indicative of a result of said decision to a user.

28. A printing method according to claim 27 further comprising the step of:

if it is decided that said adjustment is necessary, adjusting said actuating timing of said print head upon bidirectional printing, or adjusting said gap between said print head and said medium, based on said information relating to said thickness having been read out.

29. A printing method according to claim 27, wherein said step of notifying said user of said message indicative of said result of decision Is a step of making a window including said message indicative of said result of decision pop-up on a display portion of a host device.

30. A storing medium storing a program for performing printing on a recording medium, said program making a computer execute the steps of:

reading out information relating to a thickness of said recording medium from storage means provided on said recording medium; and adjusting an actuating timing of a print head upon bidirectional printing based on said information relating to said thickness having been read out.

31. A storing medium storing a program for performing printing on a recording medium, said program making a computer execute the steps of:

reading out information relating to a type of said recording medium from storage means provided on said recording medium;

based on said information relating to said type having been read out, deciding whether or not an adjustment of a gap between a print head and said recording medium, or an adjustment of an actuating timing of said print head upon bidirectional printing is necessary; and if it is decided that said adjustment is necessary, notifying a message indicative of a result of said decision to a user.

32. A printing apparatus for printing on a printing medium comprising:

a printing medium having a storage element to which print-control information adapted to a type of said printing medium is stored;

print-control information provided in advance;

an identifying unit for identifying said type of printing medium being set;

a controller for determining whether or not print-control information adapted to said type of said printing medium identified by said identifying unit is included in said print-control information provided in advance, and controlling printing according to a result of said determination using either:

said print-control information provided in advance, or said print-control information stored in said storage element and adapted to said type of said printing medium having been identified.

33. A printing apparatus for printing on a printing medium comprising:

an identifying unit for identifying a type of said printing medium being used;

a reader for reading in medium-feed-controlling information adapted to said type of said printing medium identified by said identifying unit from a location to which said medium-feed-controlling information is stored, said medium-feed-controlling information being information adapted to said type of said printing medium and for controlling an amount of said printing medium to be fed; and a controller for controlling said amount of said printing medium to be fed based on said medium-feed-controlling information read in by said reader.

* * * * *